US006212898B1

(12) United States Patent
Ueno et al.

(10) Patent No.: US 6,212,898 B1
(45) Date of Patent: Apr. 10, 2001

(54) REFRIGERATION SYSTEM

(75) Inventors: Akitoshi Ueno; Yuji Fujimoto; Takenori Mezaki; Yoshihiro Nishioka; Yasutoshi Mizutani, all of Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/147,563

(22) PCT Filed: Jun. 3, 1998

(86) PCT No.: PCT/JP98/02441

§ 371 Date: Jan. 21, 1999

§ 102(e) Date: Jan. 21, 1999

(87) PCT Pub. No.: WO98/55809

PCT Pub. Date: Dec. 10, 1998

(30) Foreign Application Priority Data

Jun. 3, 1997 (JP) ..... 9-145022

(51) Int. Cl.[7] ..... F25B 7/00
(52) U.S. Cl. ..... 62/335
(58) Field of Search ..... 62/335, 79, 175

(56) References Cited

U.S. PATENT DOCUMENTS

| | | | | |
|---|---|---|---|---|
| 4,149,389 | * | 4/1979 | Hayes et al. | 62/335 |
| 4,176,525 | * | 12/1979 | Tucker et al. | 62/335 |
| 4,194,368 | * | 3/1980 | Bahel et al. | 62/335 |
| 4,325,226 | * | 4/1982 | Schaeffer | 62/335 |
| 4,484,449 | * | 11/1984 | Muench | 62/335 |
| 5,335,508 | * | 8/1994 | Tippmann | 62/335 |
| 5,740,679 | | 4/1998 | Ueno et al. | 62/175 |

FOREIGN PATENT DOCUMENTS

| | | |
|---|---|---|
| 2273763 | 6/1994 | (GB) . |
| 58-178159 | 10/1983 | (JP) . |
| 1-247966 | 10/1989 | (JP) . |
| 5-5567 | 1/1993 | (JP) . |
| 7-243727 | 9/1995 | (JP) . |
| 304451 | 12/1998 | (NO) . |
| 463 227 | 10/1999 | (SE) . |
| WO9014566 | 11/1990 | (WO) . |
| WO9621831 | 7/1996 | (WO) . |

* cited by examiner

*Primary Examiner*—William E. Tapolcal
(74) *Attorney, Agent, or Firm*—Nixon Peabody LLP; Donald R. Studebaker

(57) ABSTRACT

An outdoor unit (1), a parent unit (2), a plurality of child freezers, and a plurality of child refrigerators are provided. The child freezers are disposed in individual frozen display cases, while the child refrigerators are disposed in individual refrigerated display cases. A refrigerant heat exchanger (5) is disposed in only the parent unit (2). The outdoor unit (1) and the refrigerant heat exchanger (5) form a primary refrigerant circuit. A secondary refrigerant circuit is provided in the parent unit (2). Refrigerant circulates through the secondary refrigerant circuit, passing through the refrigerant heat exchanger (5). Each child freezer is provided with a refrigeration utilization side heat exchanger (3*c*) and the heat exchanger (3*c*) and the refrigerant heat exchanger (5) form a secondary refrigerant circuit through which refrigerant circulates. Together with the outdoor unit (1), a heat exchanger which is disposed in each of the child refrigerators forms a secondary refrigerant circuit of a unary refrigeration cycle.

10 Claims, 11 Drawing Sheets

REFRIGERATION SYSTEM

TECHNICAL FIELD

The present invention relates to a refrigeration system employing a primary refrigerant circuit and a secondary refrigerant circuit for the purpose of transferring heat between the primary and secondary refrigerant circuits. This invention particularly pertains to a refrigeration system having a plurality of heat exchangers on the side where refrigerant heat is utilized.

BACKGROUND ART

Various refrigeration systems have been known. One such example of a refrigeration system is disclosed in Japanese Patent Application Kokai (not examined) Gazette No. 5-5567. The apparatus shown in the 5-5567 patent utilizes a binary refrigeration cycle and includes a primary refrigerant circuit through which a primary refrigerant passes and a secondary refrigerant circuit through which a secondary refrigerant passes. The exchanging of heat between the primary refrigerant and the secondary refrigerant takes place in a refrigerant heat exchanger. Such a refrigerant heat exchanger is called a cascade heat exchanger.

Some of refrigeration systems of the above-described type employ multiple secondary refrigerant circuits with respect to one primary refrigerant circuit with a view to providing a great deal of flexibility. This sole primary refrigerant circuit is shared as a source of heat among multiple heat exchangers disposed on the side where refrigerant heat is utilized.

Such a conventional refrigeration system employs a structure comprising a plurality of cooling units disposed on the indoor side. Each cooling unit is provided with an individual secondary refrigerant circuit. In other words, the primary refrigerant circuit includes liquid and gas flow lines which are branched out into liquid and gas flow branch lines. These branch lines are guided to individual cooling units. In each cooling unit, heat is exchanged between primary and secondary refrigerants in the refrigerant heat exchanger.

Each of the cooling units is arranged in series with the liquid flow line of the primary refrigerant circuit. As a result of such arrangement, the primary refrigerant passes through the cooling units in sequence. In each of the cooling units, a heat exchange takes place between primary and secondary refrigerants.

PROBLEMS THAT THE INVENTION INTENDS TO SOLVE

In conventional refrigeration systems, each cooling unit is required to contain an individual refrigerant heat exchanger when a single primary refrigerant circuit is shared as a source of heat among multiple heat exchangers disposed on the side where refrigeration is utilized. This results in the requirement that the same number of refrigerant heat exchangers as the number of secondary refrigerant circuits be prepared.

In addition to the above, each cooling unit is required to individually include a secondary, closed refrigerant circuit made up of a compressor, a condenser, an expansion valve, and a vaporizer. This results in an entire circuit configuration suffering an increased complexity.

Such a conventional refrigeration system is only applicable to refrigerator units each having an individual, closed loop of the above-described type. For instance, in the case the foregoing refrigeration system is applied to frozen display cases, the frozen display cases are provided with their respective cooling units and are coupled to a sole outdoor unit. This means that each frozen display case requires the provision of a refrigerant heat exchanger and a secondary closed refrigerant circuit.

Display cases are generally classified into two categories, namely (a) frozen display cases each containing therein an individual freeze loop and (b) refrigerated display cases each containing therein only a heat exchanger (vaporizer) of a unary refrigeration cycle.

Conventional refrigeration systems can find applications in only frozen display cases completed with freeze loops. This produces the problem that conventional refrigeration systems are inapplicable to cases where multiple display cases requiring different cooling temperatures are employed.

In view of the above-described problems with the prior art techniques, the present invention was made. Accordingly, an object of the present invention is to provide a novel technique capable of providing simplified circuit structures to refrigeration systems each containing a single primary refrigerant circuit that is shared as a source of heat among multiple heat exchangers disposed on the side where refrigerant heat is utilized and of allowing the heat exchangers to be used in various application manners.

DISCLOSURE OF THE INVENTION

In accordance with the present invention, a refrigerant heat exchanger is disposed in only a particular one of cooling units. In addition, a closed loop is composed of the refrigerant heat exchanger and a heat exchanger disposed on the side where refrigeration (produced by the refrigeration system) is utilized.

The present invention provides a first solving means (shown in FIGS. 3 and 6) for solving the foregoing problems associated with the prior art techniques. The first solving means of the present invention is directed to a refrigeration system comprising a primary refrigerant circuit (10), a secondary refrigerant circuit (20), and a refrigerant heat exchanger (5) for the exchanging of heat between refrigerant which circulates through the primary refrigerant circuit (10) and refrigerant which circulates through the secondary refrigerant circuit (20), for the purpose of transferring heat between the primary refrigerant circuit (10) and the secondary refrigerant circuit (20).

The first solving means of the present invention is characterized in that (a) the secondary refrigerant circuit (20) includes heat exchangers **(11*b*, 3*a*) disposed on the side where refrigerant heat is utilized and refrigerant circulates between each of the heat exchangers (11*b*, 3*c*) and the refrigerant heat exchanger (5), (b) the heat exchanger (11*b*) and the refrigerant heat exchanger (5) are placed in a unit (2*a*), and (c) the heat exchangers (3*c*) is connected to the refrigerant heat exchanger (5) by refrigerant lines (LL-A, GL-A) extending from the unit (2*a*)**.

In the first solving means of the present invention, heat is exchanged between the primary refrigerant of the primary refrigerant circuit (10) and the secondary refrigerant of the secondary refrigerant circuit (20) in the refrigerant heat exchanger (5) mounted in the unit **(2*a*). Refrigerant circulates between the heat exchanger (11*b*) and the refrigerant heat exchanger (5) both of which are housed in the unit (2*a*). At the same time, refrigerant circulates between the other heat exchanger (3*c*) and the refrigerant heat exchanger (5) by way of the refrigerant lines (LL-A, GL-A). The heat exchangers (11*b*, 3*c*)** perform their respective cooling operations.

The heat exchanger **(3*c*), which is located exterior to the unit (2*a*), uses the refrigerant heat exchanger (5) as a source of heat. The refrigerant heat exchanger (5) is disposed in the unit (2*a*)**.

The present invention provides a second solving means (shown in FIG. 3) for solving the foregoing problems associated with the prior art techniques. The second solving means of the present invention is directed to a refrigeration system comprising a primary refrigerant circuit (10), secondary refrigerant circuits (11, 12), and a refrigerant heat exchanger (5) for the exchanging of heat between refrigerant which circulates through the primary refrigerant circuit (10) and refrigerant which circulates through each of the secondary refrigerant circuits (11, 12), for the purpose of transferring heat between the primary refrigerant circuit (10) and each of the secondary refrigerant circuits (11, 12).

The second solving means of the present invention is characterized in that: (a) a plurality of the secondary refrigerant circuits (11) are provided, a plurality of the secondary refrigerant circuits (12) are provided, the secondary refrigerant circuits (11) include individual heat exchangers (11*b*) disposed on the side where refrigerant heat is utilized, the secondary refrigerant circuits (12) include individual heat exchangers (3*c*) disposed on the side where refrigerant heat is utilized, refrigerant circulates between each of the heat exchangers (11*b*) and the refrigerant heat exchanger (5), and refrigerant circulates between each of the heat exchangers (3*c*) and the refrigerant heat exchanger (5), (b) a particular one of the secondary refrigerant circuits (11) and the refrigerant heat exchanger (5) are placed in a main unit (2*a*), and (c) each of the heat exchangers (3*c*) of the secondary refrigerant circuits (12) is placed in a subunit (3*a*) and is connected to the refrigerant heat exchanger (5) by refrigerant lines (LL-A, GL-A) extending from the main unit (2*a*).

The present invention provides a third solving means (see FIG. 6) for solving foregoing problems associated with the prior art techniques The third solving means of the present invention is directed to a refrigeration system comprising a primary refrigerant circuit (10), a secondary refrigerant circuit (11), and a refrigerant heat exchanger (5) for the exchanging of heat between refrigerant which circulates through the primary refrigerant circuit (10) and refrigerant which circulates through the secondary refrigerant circuit (11), for the purpose of transferring heat between the primary refrigerant circuit (10) and the secondary refrigerant circuit (11).

The third solving means of the present invention is characterized in that (a) the secondary refrigerant circuit (20) includes heat exchangers (11*b*, 3*c*) disposed on the side where refrigerant heat is utilized and connected in parallel with each other and refrigerant circulates between each of the heat exchangers (11*b*, 3*c*) and the refrigerant heat exchanger (5), (b) the heat exchanger (11*b*) and the refrigerant heat exchanger (5) are placed in a main unit (2*a*), and (c) the heat exchanger (3*c*) is placed in a subunit (3*a*) and Is connected to the refrigerant heat exchanger (5) by refrigerant lines (LL-A, GL-A) extending from the main unit (2*a*).

In accordance with the second and third solving means of the present invention, there is no need for the provision of the refrigerant heat exchanger (5) in the subunit (3*a*). In other words, the refrigerant heat exchanger (5) of the main unit (2*a*) serves as a source of heat for the heat exchangers (11*b*, 3*c*), therefore providing a simplified structure for the subunit (3*a*).

The present invention provides a fourth solving means (see FIGS. 9 and 10) for solving the foregoing problems associated with the prior art techniques. The fourth solving means of the present invention is directed to a refrigeration system comprising a primary refrigerant circuit (10), a secondary refrigerant circuit (12), and a refrigerant heat exchanger (5) for the exchanging of heat between refrigerant which circulates through the primary refrigerant circuit (10) and refrigerant which circulates through the secondary refrigerant circuit (12), for the purpose of transferring heat between the primary refrigerant circuit (10) and the secondary refrigerant circuit (12).

The fourth solving means of the present invention is characterized in that (a) the primary refrigerant circuit (10) includes a first heat exchanger (11*b*) which is disposed on the side where refrigerant heat is utilized and which is connected in parallel with the refrigerant heat exchanger (5), (b) the secondary refrigerant circuit (12) includes a second heat exchanger (3*c*) which is disposed on the side where refrigerant heat is utilized and refrigerant circulates between the second heat exchanger (3*c*) and the refrigerant heat exchanger (5), (c) the first heat exchanger (11*b*) and the refrigerant heat exchanger (5) are placed in a unit (2*a*), and (d) the second heat exchanger (3*c*) is connected to the refrigerant heat exchanger (5) by refrigerant lines (LL-A, GL-A) extending from the unit (2*a*).

In accordance with the fourth solving means of the present invention, the first heat exchanger (11*b*) forms a part of the primary refrigerant circuit (10). In other words, while the first heat exchanger (11*b*) is used as a refrigeration utilization side heat exchanger in a unary refrigeration cycle, the unit (2*a*), which contains therein the first heat exchanger (11*b*), accommodates the refrigerant heat exchanger (5) The refrigerant heat exchanger (5) acts as a source of heat for the second heat exchanger (3*c*).

The present invention provides a fifth solving means (see FIG. 9) for solving the foregoing problems associated with the prior art techniques. The fifth solving means of the present invention is directed to a refrigeration system comprising a primary refrigerant circuit (10), a secondary refrigerant circuit (12), and a refrigerant heat exchanger (5) for the exchanging of heat between refrigerant which circulates through the primary refrigerant circuit (10) and refrigerant which circulates through the secondary refrigerant circuit (12), for the purpose of transferring heat between the primary refrigerant circuit (10) and the secondary refrigerant circuit (12).

The fifth solving means of the present invention is characterized in that (a) the primary refrigerant circuit (10) includes a first heat exchanger (11*b*) which is disposed on the side where refrigerant heat is utilized and which is connected in parallel with the refrigerant heat exchanger (5), (b) the secondary refrigerant circuit (12) includes a second heat exchanger (3*c*) which is disposed on the side where refrigerant heat is utilized and refrigerant circulates between the second heat exchanger (3*c*) and the refrigerant heat exchanger (5), (c) the first heat exchanger (11*b*) and the refrigerant heat exchanger (5) are placed in a unit (2*a*), and (d) the second heat exchanger (3*c*) is placed in a subunit (3*a*) and is connected to the refrigerant heat exchanger (5) by refrigerant lines (LL-A, GL-A) extending from the main unit (2*a*).

The present invention provides a sixth solving means (see FIG. 10) for solving the foregoing problems associated with the prior art techniques. The sixth solving means of the present invention is directed to a refrigeration system comprising a primary refrigerant circuit (10), a secondary refrigerant circuit (11), and a refrigerant heat exchanger (5) for the exchanging of heat between refrigerant which circulates through the primary refrigerant circuit (10) and refrigerant which circulates through the secondary refrigerant circuit (11), for the purpose of transferring heat between the primary refrigerant circuit (10) and the secondary refrigerant circuit (11).

The sixth solving means of the present invention is characterized in that (a) the primary refrigerant circuit (10) includes a first heat exchanger (11*b*) which is disposed on the side where refrigerant heat is utilized and which is connected in parallel with the refrigerant heat exchanger (5), (b) the secondary refrigerant circuit (11) includes a plurality of heat exchangers (3*c*) which are disposed on the side where refrigerant heat is utilized and which are connected in parallel with one another and wherein refrigerant circulates between each of the heat exchangers (3*c*) and the refrigerant heat exchanger (5), (c) the first heat exchanger (11*b*) and the refrigerant heat exchanger (5) are placed in a main unit (2*a*), and (d) each of the second heat exchangers (3*c*) is placed in an individual subunit (3*a*) and is connected to the refrigerant heat exchanger (5) by refrigerant lines (LL-A. GL-A) extending from the main unit (2*a*).

In the fifth and sixth solving means of the present invention, there is no need for the provision of the refrigerant heat exchanger (5) in the subunit (3*a*), while the first heat exchanger (11*b*) is used as a refrigeration utilization side heat exchanger in a unary refrigeration hicycle. In other words, the refrigerant heat exchanger (5) of the main unit (2*a*) acts as a source of heat for the second heat exchangers (3*c*).

The present invention provides a seventh solving means (according to either one of the foregoing second and fifth solving means) for solving the foregoing problems associated with the prior art techniques. The seventh solving means of the present invention is characterized in that (a) the subunit (3*a*) contains therein a secondary compressor (3*b*), (b) the secondary compressor (3*b*) has a discharge side which is connected to a gas side of the refrigerant heat exchanger (5) through a gas line (GL-A), and (c) the heat exchanger (3*c*) of the subunit (3*a*) has a liquid side which is connected to a liquid side of the refrigerant heat exchanger (5) through a decompression mechanism (EV-2) and through a liquid line (LL-A).

In accordance with the seventh solving means of the present invention, a refrigerant discharged from the secondary compressor (3*b*) flows into the refrigerant heat exchanger (5) through the gas line (GL-A), exchanges heat with a refrigerant in the primary refrigerant circuit (10), and becomes condensed. Thereafter, the condensed refrigerant is decompressed in the decompression mechanism (EV-2) and is vaporized in the heat exchanger (3*c*) for given cooling operations.

The present invention provides an eighth solving means (according to either one of the foregoing third and sixth solving means) for solving the foregoing problems associated with the prior art techniques. The eighth solving means of the present invention is characterized in that (a) the secondary refrigerant circuit (11) of the main unit (2*a*) is formed by sequential connection of a secondary compressor (3*b*), a decompression mechanism (EV-1), the heat exchanger (11*b*), and the refrigerant heat exchanger (5) and (b) the heat exchanger (3*c*) of the subunit (3*a*) has a liquid side which is connected to a liquid side of the refrigerant heat exchanger (5) by a liquid line (LL-A) and the heat exchanger (3*c*) has a gas side which is connected to a suction side of the secondary compressor (3*b*) by a gas line (GL-A).

In accordance with the eighth solving means of the present invention, a refrigerant discharged from the secondary compressor (3*c*) becomes condensed in the refrigerant heat exchanger (5), wherein a part of the condensed refrigerant is vaporized in the heat exchanger (11*b*) of the main unit (2*a*) and the other condensed refrigerant is passed to the heat exchanger (3*c*) of the subunit (3*a*) through the liquid line (LL-A) and is vaporized there. As a result, the heat exchangers (11*b*, 3*c*) perform their respective given cooling operations.

The present invention provides a ninth solving means (according to any one of the foregoing second, third, fifth, and sixth solving means) for solving the foregoing problems associated with the prior art techniques. The ninth solving means of the present invention is characterized in that (a) the primary refrigerant circuit (10) includes a refrigeration utilization side heat exchanger (4*b*) which is connected in parallel with the refrigerant heat exchanger (5) and which is placed in a subunit (4*a*) and (*b*) the heat exchanger (4*b*) has a liquid side and a gas side wherein the liquid side is connected to a liquid side of the refrigerant heat exchanger (5) by a liquid line (LL-B) and the gas side is connected to a gas side of the refrigerant heat exchanger (5) by a gas line (GL-B).

In accordance with the ninth solving means of the present invention, a part of the primary refrigerant circuit (10) constitutes a unary refrigeration cycle. In other words, only with the provision of a single heat source (i.e. the primary refrigerant circuit (10)), the heat exchanger (3*c*) in a binary refrigeration cycle is allowed to coexist with the heat exchanger (4*b*) in a unary refrigeration cycle.

The present invention provides a tenth solving means (according to either one of the foregoing first to sixth solving means) for solving the foregoing problems associated with the prior art techniques. The tenth solving means of the present invention is characterized in that each of the heat exchangers (11*b*, 3*c*, 4*b*) exchanges heat with air within an individual food display case to cool the air.

In accordance with the tenth solving means of the present invention, simplified structures for use in food display cases are provided thereby contributing to the saving of the area of display cases.

EFFECTS OF THE INVENTION

An effect of the first solving means of the present invention is that the refrigerant heat exchanger (5) can be shared as a source of heat between the heat exchangers (11*b*, 3*c*).

In addition to the above, with only the provision of the refrigerant heat exchanger (5) in the unit (2*a*), it becomes possible to cause refrigerant to vaporize in the heat exchangers (11*b*, 3*c*).

In other words, there is no need to provide an individual refrigerant heat exchanger to each of the heat exchangers (11*b*, 3*c*), because of which there is no need to secure area necessary for installing the refrigerant heat exchanger (5) in each unit. As a result, it becomes possible to provide simplified circuit structures for refrigeration systems.

In addition, by virtue of the structure of the secondary refrigerant circuit (20), various temperature environments requiring different cooling temperatures can be realized. This makes it possible to achieve a wider range of applications of the present refrigeration system.

An effect of the second solving means of the present invention is that there is no need for the provision of the refrigerant heat exchanger (5) in the subunit (3*a*), which makes it possible to provide simplified circuit structures applicable in refrigeration systems. Further, in addition to the foregoing effect of the first solving means, the second solving means can provide the advantage that since a plurality of secondary refrigerant circuits (i.e. the secondary refrigerant circuits (11, 12)) are provided, this makes it possible to set, for example, individual cooling performance to the secondary refrigerant circuits (11, 12).

An effect of the third solving means of the present invention is that there is no need for the provision of the refrigerant heat exchanger (5) in the subunit (3*a*), which makes it possible to provide simplified circuit structures applicable in refrigeration systems. Further, in addition to the foregoing effect of the first solving means, the third solving means can provide the advantage that since the secondary refrigerant circuit (11) is provided with a plurality of heat exchangers (i.e., the heat exchangers (11*b*, 3*c*)), this makes it possible to facilitate, for example, the connecting of lines.

In accordance with the second and third solving means of the present invention, it becomes possible to employ such a structure that components including compressors are placed in the main unit (2*a*) while the subunit (3*a*) contains therein only the heat exchanger (3*c*). Accordingly, the units (2*a*, 3*c*) with different cooling temperatures can coexist, thereby providing improved flexibility.

An effect of the fourth solving means of the present invention is that the first heat exchanger (11*b*), which is connected In parallel with the refrigerant heat exchanger (5), is disposed in the primary refrigerant circuit (10), and the first heat exchanger (11*b*) is placed in the unit (2*a*) together with the refrigerant heat exchanger (5). Such arrangement makes it possible to construct the unit (2*a*) without a compressor or the like. This provides a wider range of applications of the unit (2*a*). Additionally, like the first solving means, the fourth solving means is able to provide a simplified circuit structure.

An effect of the fifth solving means is that since the second heat exchanger (3*c*) is placed in the subunit (3*a*), this makes it possible to eliminate the need for the provision of, for example, a compressor in the subunit (3*a*). As a result, a simplified circuit structure can be provided. Like the second and third solving means, it is possible to allow the units (2*a*, 3*c*) to coexist thereby providing improved flexibility.

An effects of the sixth solving means of the present invention is that since a plurality of the second heat exchangers (3*c*) are placed in the respective subunits (3*a*), this makes it possible to easily cope with a plurality of locations, such as display cases, to be cooled. Additionally, like the first solving means, the sixth solving means provides the advantage that a simplified circuit structure can be provided. Furthermore, as in the second and third solving means, the sixth solving means makes it possible to provide the coexistence of the units (2*a*, 3*c*) thereby providing improved flexibility.

An effect of the seventh solving means of the present invention is that since the secondary compressor (3*b*) is placed in the subunit (3*a*), this makes it possible to generate a low temperature in the subunit (3*a*) thereby providing a wider range of applications.

An effect of the eighth solving means of the present invention is that since components including the secondary compressor (3*b*) are placed in the main unit (2*a*), this makes it possible to construct the subunit (3*a*) that contains therein only the heat exchanger (3*c*). This can provide a simplified circuit structure.

An effect of the tenth solving means of the present invention is that since food display cases are cooled, this achieves a saving in the area of display cases. This can provide a simplified food display case structure and at the same time, reductions in the food display case area can be achieved.

BEST MODE FOR CARRYING OUT THE INVENTION

Referring to the attached drawing figures, the details of preferred embodiments of the present invention are now described.

Each of the embodiments of the present invention will be described by way of example. Embodiment examples of the present invention, in which refrigeration systems made in accordance with the present invention are applied to refrigerated food display cases installed in supermarkets, are explained.

First Embodiment

Figure 1:
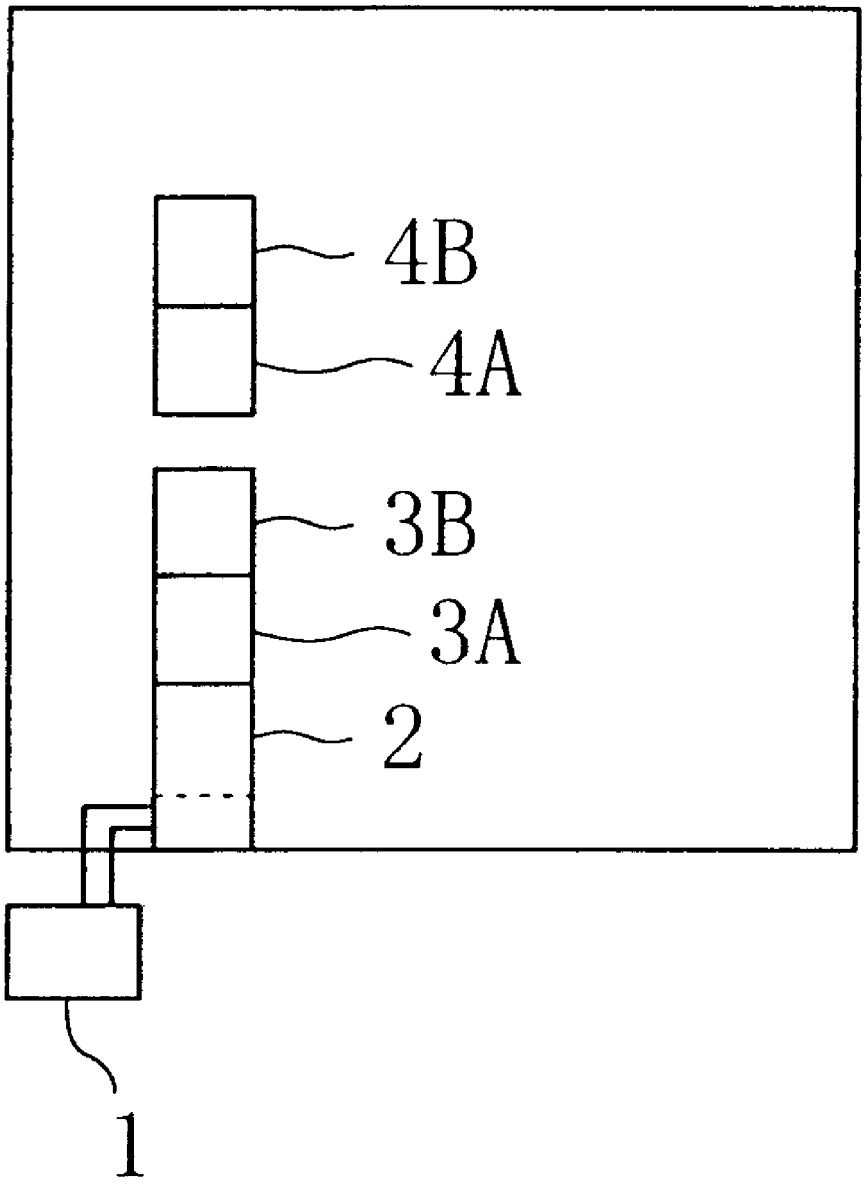
FIG. 1 is a layout drawing showing the positions of individual display cases.
Figure 2:
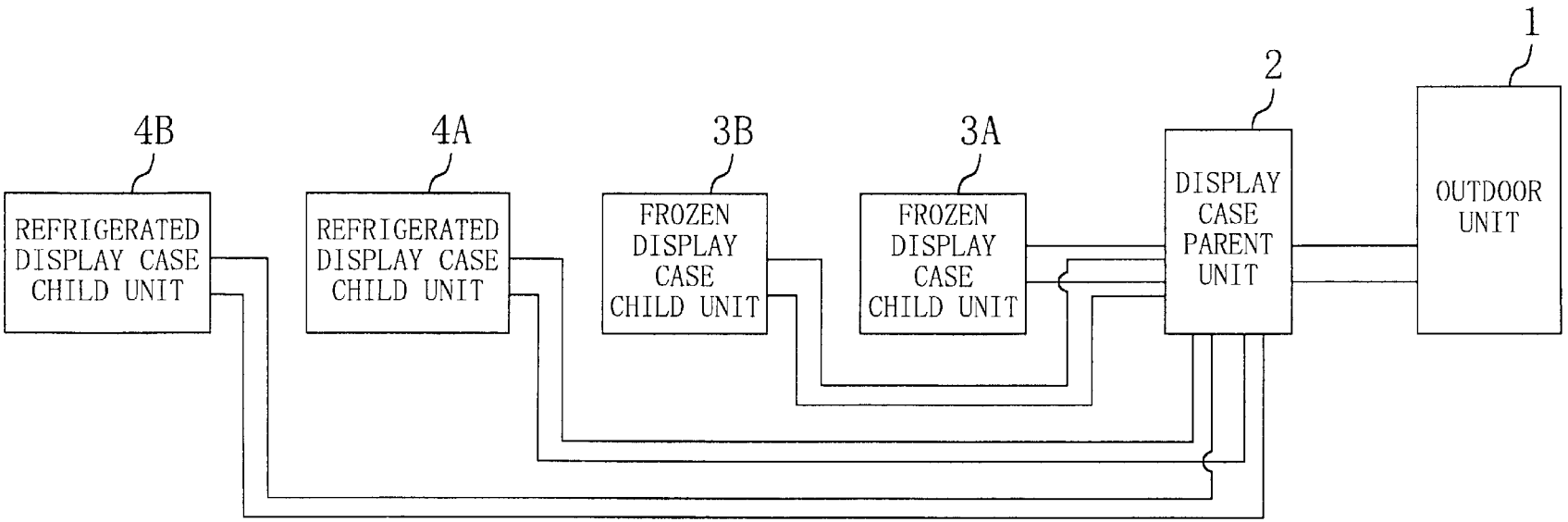
FIG. 2 is a schematic diagram showing the piping connection state of each display case.
Figure 3:
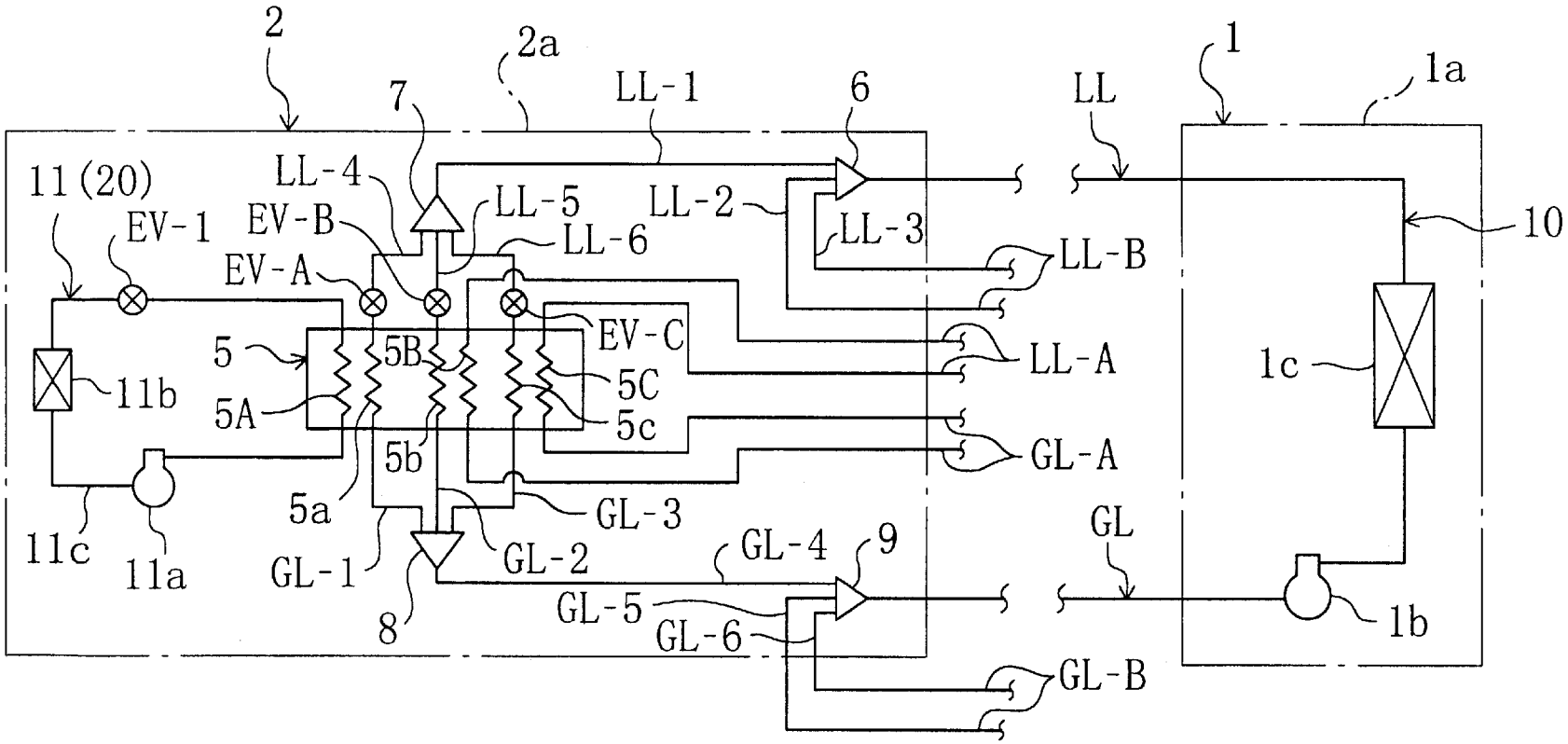
FIG. 3 is a diagram showing the refrigerant piping system of an outdoor unit and that of a parent unit in a first embodiment of the present invention.
Figure 4:
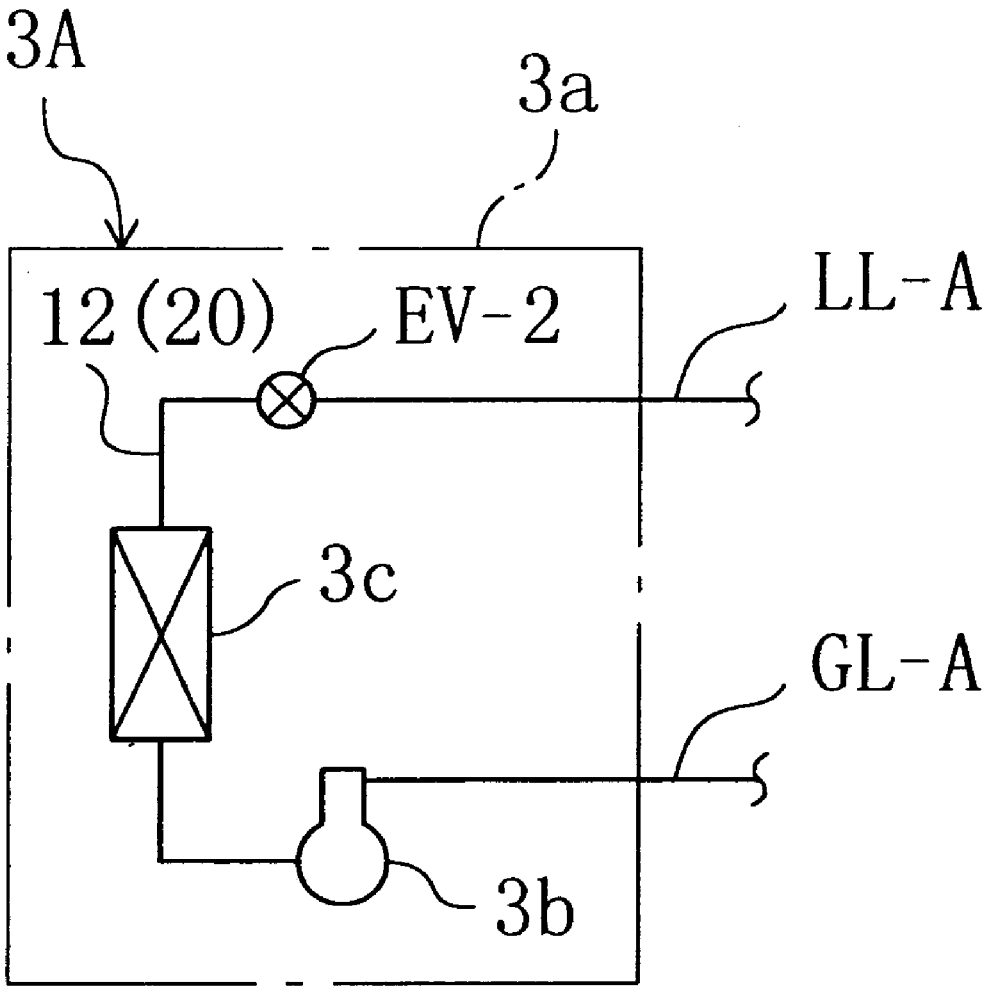
FIG. 4 is a diagram showing the piping configuration of a child freezer.
Figure 5:
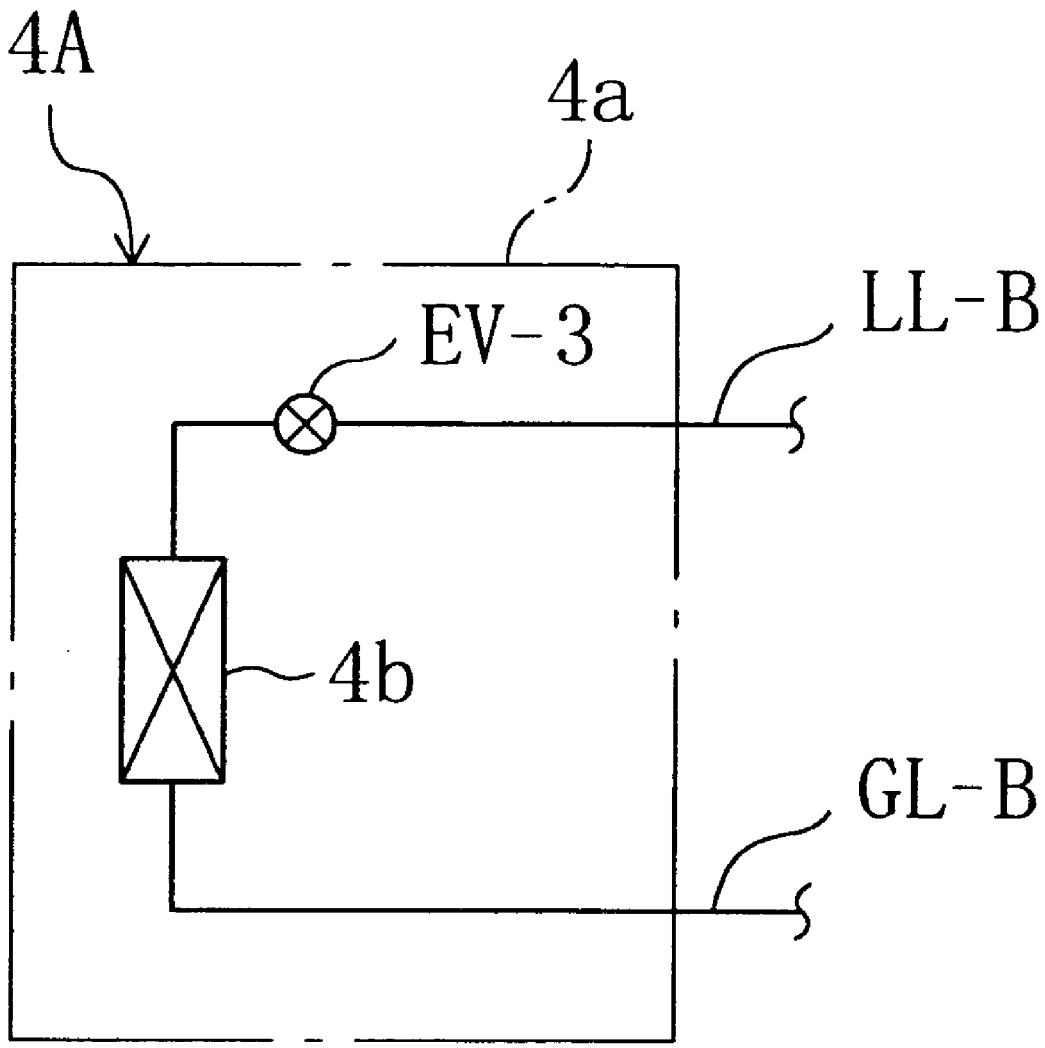
FIG. 5 is a diagram showing the piping configuration of a child refrigerator.

FIG. 1 shows the positions of individual food display cases. The food display cases of FIG. 1 contain therein cooling units (2, 3A, 3B, 4A, 4B), respectively. FIG. 2 outlines the piping connection of the cooling units (2, 3A, 3B, 4A, 4B). FIGS. 3–5 show in detail the piping connection of the cooling units (2, 3A, 3B, 4A, 4B).

Referring to FIGS. 1 and 2, a refrigeration system, formed in accordance with the first embodiment of the present invention, includes a single outdoor unit (1) in addition to the foregoing five cooling units (2, 3A, 3B, 4A, 4B). These five cooling units (2, 3A, 3B, 4A, 4B) are operable to provide refrigeration in respective food display cases. The first refrigerator unit (2) is a parent unit. The second and third cooling units (3A) and (3B) are child freezers. The fourth and fifth cooling units (4A) and (4B) are child refrigerators. Connections between the cooling units (2, 3A, 3B, 4A. 4B) and the outdoor unit (1) are established by refrigerant lines.

Refrigerant which circulates between the outdoor unit (1) and the parent unit (2) exchanges heat with refrigerant which circulates between the parent unit (2) and each of the child freezers (3A, 3B) in a refrigerant heat exchanger (5). Each of the child freezers (3A, 3B) produces a low temperature of, for example, "40 degrees centigrade to cool its corresponding frozen display case. The refrigerant heat exchanger (5), which is called a cascade heat exchanger, is housed within the parent unit (2). Like the child freezers (3A, 3B), the parent unit (2) produces a low temperature of, for example, "40 degrees centigrade to cool its corresponding frozen display case.

On the other hand, refrigerant circulates between each of the child refrigerators (4A, 4B) and the outdoor unit (1), thereby causing each of the child refrigerators (4A, 4B) to produce a low temperature of, for example, −15 degrees centigrade to cool its corresponding refrigerated display case.

Hereinafter, the circuit configuration of each of the units operable to perform the foregoing cooling operations is explained.

Outdoor Unit

The outdoor unit (1) is installed outside and is housed in a casing (1*a*). Contained in the casing (1*a*) of the outdoor unit (1) are a primary compressor (1*b*) and an outdoor heat exchanger (1*c*). The primary compressor (1*b*) and the outdoor heat exchanger (ic) are connected together by a refrigerant line. The outdoor heat exchanger (1*o*) has a liquid side to which a primary liquid line (LL) is connected. The primary compressor (1*b*) has a suction side to which a primary gas line (GL) is connected. Both the primary liquid line (LL) and the primary gas line (GL) extend from the casing (la) of the outdoor unit (1) and are connected to the parent unit (2).

Parent Unit

The parent unit (2) is a main unit and is housed in a casing (2*a*). Contained with the casing (2*a*) of the parent unit (2) is the refrigerant heat exchanger (5). The primary liquid line (LL) and the primary gas line (GL), which extend from the outdoor unit (1), are connected to the refrigerant heat exchanger (5).

Provided along the primary liquid line (LL) and in the parent unit (2) are first and second flow dividers (6, 7). Branched out from the first flow divider (6) are three upstream branch lines (LL-1, LL-2, LL-3). The upstream branch line (LL-1) is connected to the second flow divider (7). Branched out from the second flow divider (7) are three downstream branch lines (LL-4, LL-5, LL-6). Each of the downstream branch lines (LL-4, LL-5, LL-6) is connected to the refrigerant heat exchanger (5).

The refrigerant heat exchanger (5) is a plate refrigerant heat exchanger. In the refrigerant heat exchanger (5), first to third primary passages (5*a*, 5*b*, 5*c*) are formed in a corresponding fashion to the downstream branch lines (LL-4, LL-5, LL-6).

The downstream branch lines (LL-4, LL-5, LL-6) are provided with respective electric expansion valves (EV-A, EV-B, EV-C). The electric expansion valves (EV-A, EV-B, EV-C) are operable to provide, by controlling the degree of opening thereof, independent controls of the temperature of vaporization of respective refrigerants flowing in the primary passages (5*a*, 5*b*, 5*c*). Each of the primary passages (5*a*, 5*b*, 5*c*) of the refrigerant heat exchanger (5) is not necessarily required to be implemented by a single passage but is formed by a plurality of passages created by the overlapping of multiple plates.

Provided along the primary gas line (GL) and in the parent unit (2) are first and second flow merging headers (8, 9). Guide lines (GL-1, GL-2, GL-3) of the primary refrigerant of the refrigerant heat exchanger (5) are connected to the first flow merging header (8). In addition to the guide lines (GL-1, GL-2, GL-3), a flow merging line (GL-4) is connected to the first flow merging header (8). The flow merging line (GL-4) is connected to the second flow merging header (9). The second flow merging header (9) is connected, through the primary gas line (GL), to the suction side of the primary compressor (1*b*).

A primary refrigerant circuit (10) is comprised of the primary compressor (1*b*) and the refrigerant heat exchanger (5). In the primary refrigerant circuit (10), refrigerant discharged from the primary compressor (1*b*) becomes condensed in the outdoor refrigerant heat exchanger (1*c*). A part of the condensed refrigerant is decompressed at the electric expansion valves (EV-A, EV-B, EV-C), is vaporized in the refrigerant heat exchanger (5), and is brought back again to the primary compressor (1*b*). The primary refrigerant is circulated in the way described above.

The two upstream branch lines (LL-2, LL-3), which are branched out from the first flow divider (6), extend to the child refrigerators (4A, 4B). Two collecting lines (GL-5, GL-6) in communication with the second header (9) also extend to the child refrigerators (4A, 4B).

The parent unit (2) contains therein a first refrigerant circuit (11) which disposed on the side where refrigerant heat is utilized and which exchanges heat with the primary refrigerant in the refrigerant heat exchanger (5). A refrigerant line (11*c*) establishes connections among a secondary compressor (11*a*), a first secondary passage (5A) of the refrigerant heat exchanger (5), the electric expansion valve (EV-1, and a heat exchanger (11*b*) disposed on the refrigeration utilization side, to form the first refrigerant circuit (11).

The first refrigerant circuit (11) is a closed loop capable of refrigerant circulation. The first secondary passage (5A) exchanges heat with the first primary passage (5*a*). In other words, refrigerant, discharged from the secondary compressor (11*a*), exchanges heat with refrigerant in the first primary passage (5*a*) in the first secondary passage (5A) of the refrigerant heat exchanger (5) and becomes condensed. Together with the primary refrigerant circuit (10), the first refrigerant circuit (11) forms a binary refrigeration cycle.

Second and third secondary passages (5B, 5C) of the refrigerant heat exchanger (5) are connected to the child freezers (3A, 3B) by liquid lines (LL-A) and by gas lines (GL-A).

Child Freezer

The child freezers (3A, 3B) each form a subunit. These child freezers (3A, 3B) have the same structure, and one of them (the child freezer (3A)) is described here with reference to FIG. 4.

The child freezer (3A) is formed by a vapor-compression refrigeration cycle. A casing (3*a*), in which the child freezer (3A) is housed, contains a secondary compressor (3*b*), a refrigeration utilization side heat exchanger (3*c*), and the electric expansion valve (EV-2). The secondary compressor (3*b*) has a discharge side to which the gas line (GL-A) is connected. The heat exchanger (3*c*) has a liquid side to which the liquid line (LL-A) is connected. Both the gas line (GL-A) and the liquid line (LL-A) are connected to the second secondary passage (5B) of the refrigerant heat exchanger (5). A closed, second refrigeration utilized side refrigerant circuit (12) comprises the child freezer (3A) and the second secondary passage (5B).

Like the first refrigerant circuit (11), together with the primary refrigerant circuit (10), the second refrigerant circuit (12) forms a binary refrigeration cycle.

On the other hand, a closed, second refrigeration utilization side refrigerant circuit (12) is comprised of the child freezer (3B) and the third secondary passage (5C) of the refrigerant heat exchanger (5).

The first refrigerant circuit (11) and the second refrigerant circuit (12) together form a secondary refrigerant circuit (20) of the present invention.

Child Refrigerator

The child refrigerators (4A, 4B) each form a subunit. These child refrigerators (4A, 4B) have the same structure, and one of them (the child refrigerator (4A)) is described here with reference to FIG. 5.

A casing (4*a*), in which the child refrigerant unit (4A) is housed, contains a refrigeration utilization side heat exchanger (4*b*) and the electric expansion valve (EV-3). The heat exchanger (4*b*) has a gas side to which a gas line (GLB) is connected and a liquid side to which a liquid line (LL-B) is connected. The liquid line (LL-B) is guided into the parent unit (2) and is connected, via the upstream branch line (LL-2), to the first flow divider (6). On the other hand, the gas line (GL-B) is guided into the parent unit (2) and is connected, via the collecting line (GL-5), to the second header (9).

A closed circuit is comprised of the child refrigerator (4A), the primary compressor (1*b*) of the outdoor unit (1), and the outdoor heat exchanger (1*c*) of the outdoor unit (1). In other words, the child refrigerator (4A) does not form a binary refrigeration cycle. Refrigerant, which was discharged from the primary compressor (1*b*) and became condensed in the outdoor heat exchanger (lo), passes through the first flow divider (6) and is supplied directly to the child refrigerator (4A).

Also in the child refrigerator (4B), a liquid line (LL-B) is connected, via the upstream branch line (LL-3), to the first flow divider (6), while a gas line (GL-B) is connected, via the collecting line (GL-6), to the second header (9). A closed loop is comprised of the child refrigerator (4B), the primary compressor (1*b*) of the outdoor unit (1), and the outdoor heat exchanger (1*c*) of the outdoor unit (1).

As described above, together with the primary refrigerant circuit (10), the first and second refrigerant circuits (11, 12) each form a binary refrigeration cycle. On the other hand, binary refrigeration cycles are formed between the child refrigerators (4A, 4B) and the primary compressor (1*b*) and outdoor heat exchanger (1*c*).

Refrigerant Circulation Operation

The refrigerant circulation operation of the refrigeration system of the present invention is now described below.

When the cooling units disposed in the respective display cases (i.e. the parent unit (2), the child freezers (3A, 3B), and the child refrigerators (4A, 4B)) perform their respective cooling operations, the compressors (1*b*, 11*a*, 3*b*) are driven and the electric expansion valves (EV-A, EV-B, EV-C, EV-1, EV-2, EV-3) are controlled such that they open at given degrees of opening.

In other words, the electric expansion valves (EV-A, EV-B, EV-C) of the downstream branch lines (LL-4, LL-5, LL-6) of the refrigerant heat exchanger (5) control the vapor temperature of refrigerants flowing in the primary passages (5*a*, 5*b*, 5*c*) and control the amount of cold to be fed to the refrigerant circuits (11, 12).

The opening degree of the electric expansion valves (EV-1, EV-2, EV-3) located upstream of the heat exchangers (11*b*, 3*c*, 4*b*) is controlled such that the insides of the food display cases are set to selected temperatures.

In the primary refrigerant circuit (10), refrigerant discharged from the primary compressor (1*b*) exchanges heat with external air in the outdoor heat exchanger (1*c*) and is condensed to change to a liquid refrigerant. The flow of the liquid refrigerant is divided into subflows in the first flow divider (6). A part of the divided liquid refrigerant passes through the upstream branch lines (LL-2, LL-3) and the liquid lines (LL-B) extending to the child refrigerators (4A, 4B) and flows into the child refrigerators (4A, 4B). The liquid refrigerant is decompressed in the electric expansion valve (EV-3), exchanges he at with air in the refrigerated food display case, and is vaporized.

By virtue of such refrigerant vaporization, each child refrigerator (4A, 4B) is cooled to a selected temperature of, for example, −15 degrees centigrade. Thereafter, the vaporized gas refrigerants pass through the gas lines (GL-B) and through the collecting lines (GL-5, GL-6), are merged at the second flow merging header (9), and are brought back to the primary compressor (1*b*).

On the other hand, the other liquid refrigerant, branched out at the first flow divider (6), flows in the upstream branch line (LL-1), in the second flow divider (7), and in the downstream branch lines (LL-4, LL-5, LL-6). The liquid refrigerant is decompressed in the electric expansion valves (EV-A, EV-B, EV-C, EV-1, EV-2, EV-3) and flows through each primary passage (5*a*, 5*b*, 5*c*) of the refrigerant heat exchanger (5). In the refrigerant heat exchanger (5), the liquid refrigerant exchange heat with refrigerant in the refrigerant circuits (11, 12, 12) and is vaporized to change to a gas liquid. The gas refrigerant passes through the guide lines (GL-1, GL-2, GL-3). through the first flow merging header (8), and through the flow merging line (GL), flows into the second flow merging header (9), is merged with gas refrigerant returned from the child refrigerator (4A, 4B), and is brought back to the primary compressor (1*b*).

The above-described refrigerant circulation operations are carried out in the primary refrigerant circuit (10).

Next, the refrigerant circulation operation of the refrigerant circuit (11) and the refrigerant circulation operation of the refrigerant circuit (12) are now described below.

In the refrigerant circuit (11) disposed on the side where refrigerant heat is utilized, refrigerant discharged from the secondary compressor (11*a*) flows into the first secondary passage (5A) of the refrigerant heat exchanger (5). In the refrigerant heat exchanger (5), refrigerant in the refrigerant circuit (11) exchanges heat with refrigerant flowing in the first primary passage (5*a*) and is condensed to change to a liquid refrigerant. Thereafter, the liquid refrigerant is decompressed by the electric expansion valve (EV-1), exchanges heat with air in the display case, and is vaporized to change to a gas liquid. By virtue of such refrigerant vaporization, the inside of the parent unit (2) is cooled to a selected temperature of, for example, "40 degrees centigrade. Thereafter, the gas refrigerant is brought back to the secondary compressor (11*a*).

In the refrigerant circuit (12), refrigerant discharged from the secondary compressor (3*b*) passes through the gas line (GL-A) and flows into the parent unit (2). The refrigerant flows through the second and third secondary passages (5B, 5C) of the refrigerant heat exchanger (5). In the refrigerant heat exchanger (5), the refrigerant of the refrigerant circuit (12) exchanges heat with refrigerant flowing in the second and third primary passages (5*b*, 5*c*) and is condensed to change to a liquid refrigerant. Thereafter, the liquid refrigerant is brought back to the child freezers (3A, 3B) via the liquid lines (LL-A). The liquid refrigerant is decompressed in the electric expansion valve (EV-2) and exchanges heat with air in the frozen display case and is vaporized to change to a gas refrigerant. By virtue of such refrigerant vaporization, the inside of the child freezers (3A, 3B) is cooled to a selected temperature of, for instance, "40 degrees centigrade. The gas refrigerant then returns to the secondary compressor (3*b*).

The above-described refrigerant circulation operations are carried out in each refrigerant circuits (11, 12, 12).

In the refrigeration system of the present embodiment, a binary refrigeration cycle is applied to the frozen display cases (i.e. the parent unit (2) and the child freezers (3A, 3B)), while on the other hand a unary refrigeration cycle is applied to the refrigerated display cases (i.e. the child refrigerators (4A, 4B)). The parent unit (2), the child freezers (3A, 3B), and the child refrigerators (4A, 4B) share the outdoor unit (1) as a source of heat.

Additionally, the refrigerant heat exchanger (5) for forming the foregoing binary refrigeration cycle is placed in only the parent unit (2). No refrigerant heat exchangers are provided in the child freezers (3A, 3B).

In accordance with the present embodiment, the child freezer (3A, 3B) each have a simplified structure in comparison with conventional refrigeration systems in which cooling units are provided with respective refrigerant heat exchangers. In other words, the child freezers (3A, 3B) require no secondary enclosed refrigerant circuits formed by connecting together a compressor, a condenser, an expansion valve, and a vaporizer. This can provide a simplified refrigerant circuit structure.

As described in the foregoing description, the present refrigeration system includes (a) the child freezers (3A, 3B) each of which comprises the compressor (3*b*), the heat exchanger (3*c*), and the electric expansion valve (EV-2) and (b) the child refrigerators (4A, 4B) each of which comprises the heat exchanger (4*b*) and the electric expansion valve (EV-3). Accordingly, the present refrigeration system can be applicable in various display cases required to provide different cooling temperatures. As a result, the present refrigeration system has a wider range of applications in comparison with conventional ones that can find applications in only frozen display cases.

Second Embodiment

Figure 6:
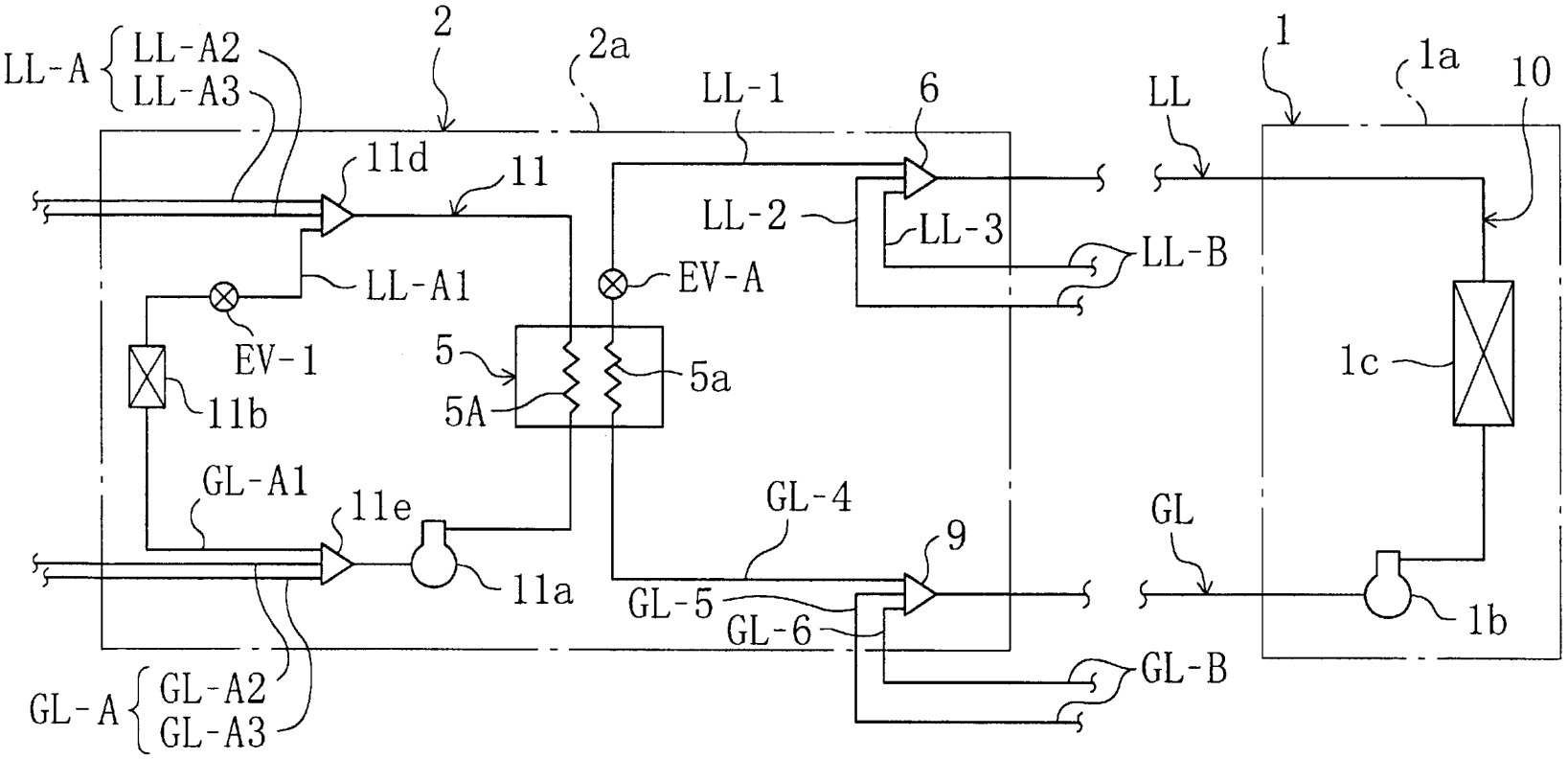
FIG. 6 is a diagram showing the refrigerant piping system of an outdoor unit and that of a parent unit in a second embodiment of the present invention.
Figure 7:
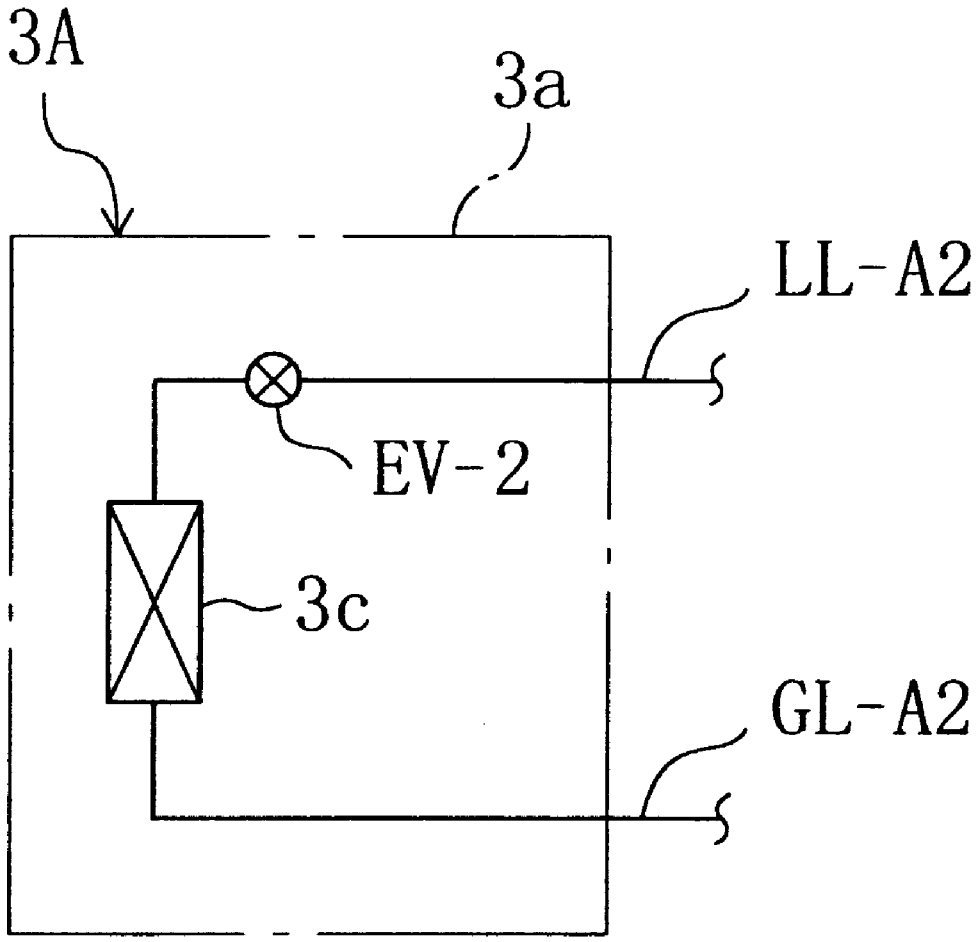
FIG. 7 is a diagram showing the piping configuration of a child freezer in the second embodiment of the present invention.

Referring to FIGS. 6 and 7, a second embodiment of the present invention is now described below.

The second embodiment differs from the first embodiment in the structure of the parent unit (2) and in the structure of the child freezers (3A, 3B), and only differences between the first and second embodiments are described here.

Parent Unit

The parent unit (2) of the second embodiment includes neither the second flow divider (7) nor the first flow merging header (8). The refrigerant heat exchanger (5) contains therein only two passages (i.e. the primary passage (5*a*) and the secondary passage (5A)).

The branch line (LL-1) extending from the flow divider (6) to the refrigerant heat exchanger (5) is connected to the primary passage (5*a*) of the refrigerant heat exchanger (5) through the electric expansion valve (EV-A). The primary passage (5*a*) has a guide end which is connected to the flow merging header (9) through the collecting line (GL-4).

Disposed between the refrigerant heat exchanger (5) and the electric expansion valve (EV-1) in the refrigerant circuit (11) is a flow divider (lid). Disposed between the heat exchanger (11*b*) and the secondary compressor (11*a*) in the refrigerant circuit (11) is a flow merging header (11*e*).

Branched out from the flow divider (11*d*) are a first liquid flow branch line (LL-A1) in communication with the heat exchanger (11*b*), a second liquid flow branch line (LL-A2), and a third liquid flow branch line (LL-A3). The second and third liquid flow branch lines (LL-A2, LL-A3) extend from the parent unit (2) to the child freezers (3A, 3B). Branched out from the flow merging header (11*e*) are a first gas flow branch line (GL-A1) in communication with the heat exchanger (11*b*), a second gas flow branch line (GL-A2), and a third gas flow branch line (GL-A3). The second and third gas flow branch lines (GL-A2, GL-A3) extend from the parent unit (2) to the child freezers (3A, 3B).

Child Freezer

The above-mentioned child freezers (3A, 3B) are constructed in the same way that the child refrigerators (4A, 4B) of the first embodiment are constructed. As shown in FIG. 7, the casing (3*a*) of each child freezer (3A, 3B) contains therein the heat exchanger (3*c*) and the electric expansion valve (EV-2). The heat exchanger (3*c*) has a gas side which is connected to the flow divider (lid) of the parent unit (2) by the gas flow branch line (GL-A2) and a liquid side which is connected to the flow divider (lid) of the parent unit (2) by the liquid flow branch line (LL-A2).

In other words, the heat exchanger (3*c*) of each of the child freezers (3A, 3B) is connected in parallel with the heat exchanger (11*b*) of the parent unit (2). There is formed a binary refrigeration cycle between the heat exchanger (3*c*) of each child freezer (3A, 3B) and the primary refrigerant circuit (10) and between the heat exchanger (11*b*) of the parent unit (2) and the primary refrigerant circuit (10).

The child refrigerators (4A, 4B) of the present embodiment have the same structure as the child refrigerators (4A, 4B) of the first embodiment (see FIG. 5), and the structure of the child refrigerators (4A, 4B) of the present embodiment is not described here.

Refrigerant Circulation Operation

The refrigerant circulation operation in the present invention is now described below.

The refrigerant circulation operation of the primary refrigerant circuit (10) is the same as in the first embodiment, and the description thereof is omitted here.

In the refrigerant circuit (11), refrigerant discharged from the secondary compressor (11*a*) flows through the secondary passage (5A) of the refrigerant heat exchanger (5). In the refrigerant heat exchanger (5), the refrigerant in the refrigerant circuit (11) exchanges heat with refrigerant flowing in the primary passage (5*a*) and is condensed to change to a liquid refrigerant. Thereafter, the flow of the liquid refrigerant is divided into subflows by the flow divider (11*d*). Refrigerant in one of the liquid refrigerant subflows is decompressed by the electric expansion valve (EV-1) in the parent unit (2), exchanges heat with air in the display case, and is vaporized to change to a gas refrigerant. By virtue of such refrigerant vaporization, the inside of the parent unit (2)

is cooled to a selected temperature. Thereafter, the gas refrigerant passes through the flow merging header (11*e*) and is brought back to the secondary compressor (11*a*).

Refrigerant in the other liquid refrigerant subflows divided in the flow divider (11*d*) passes through the liquid flow branch lines (LL-A2, LL-A3), enters the parent unit (2), and flows into the child freezers (3A, 3B) from the parent unit (2). In each of the child freezers (3A, 3B), the liquid refrigerant is decompressed by the electric expansion valve (EV-2), exchanges heat with air in the frozen display case in the heat exchanger (3*c*), and is vaporized to change to a gas refrigerant. By virtue of such refrigerant vaporization, the inside of each of the child freezers (3A, 3B) is cooled to a selected temperature. Thereafter, the gas refrigerant passes through the gas flow branch lines (GL-A2, GL-A3), is brought back to the parent unit (2). is merged with the aforesaid refrigerant in the flow merging header (11*e*), and returns to the secondary compressor (11*a*).

The above-described refrigerant circulation operations are carried out in the refrigerant circuit (11).

In the present embodiment, the refrigerant circuit (11) is implemented by a single closed loop. The heat exchangers (11*b*, 3*c*, 3*c*), which are disposed on the side where refrigerant heat is utilized, are connected in parallel and are arranged in the individual display cases. Accordingly, the requirement for the refrigerant heat exchanger (5) is just to include a pair of passages capable of the exchanging of heat therebetween. Unlike the first embodiment, the refrigerant heat exchanger (5) of the present embodiment does not require multiple, various refrigerant passages, whereby the refrigerant heat exchanger (5) can have a simplified structure.

Third Embodiment

Figure 8:
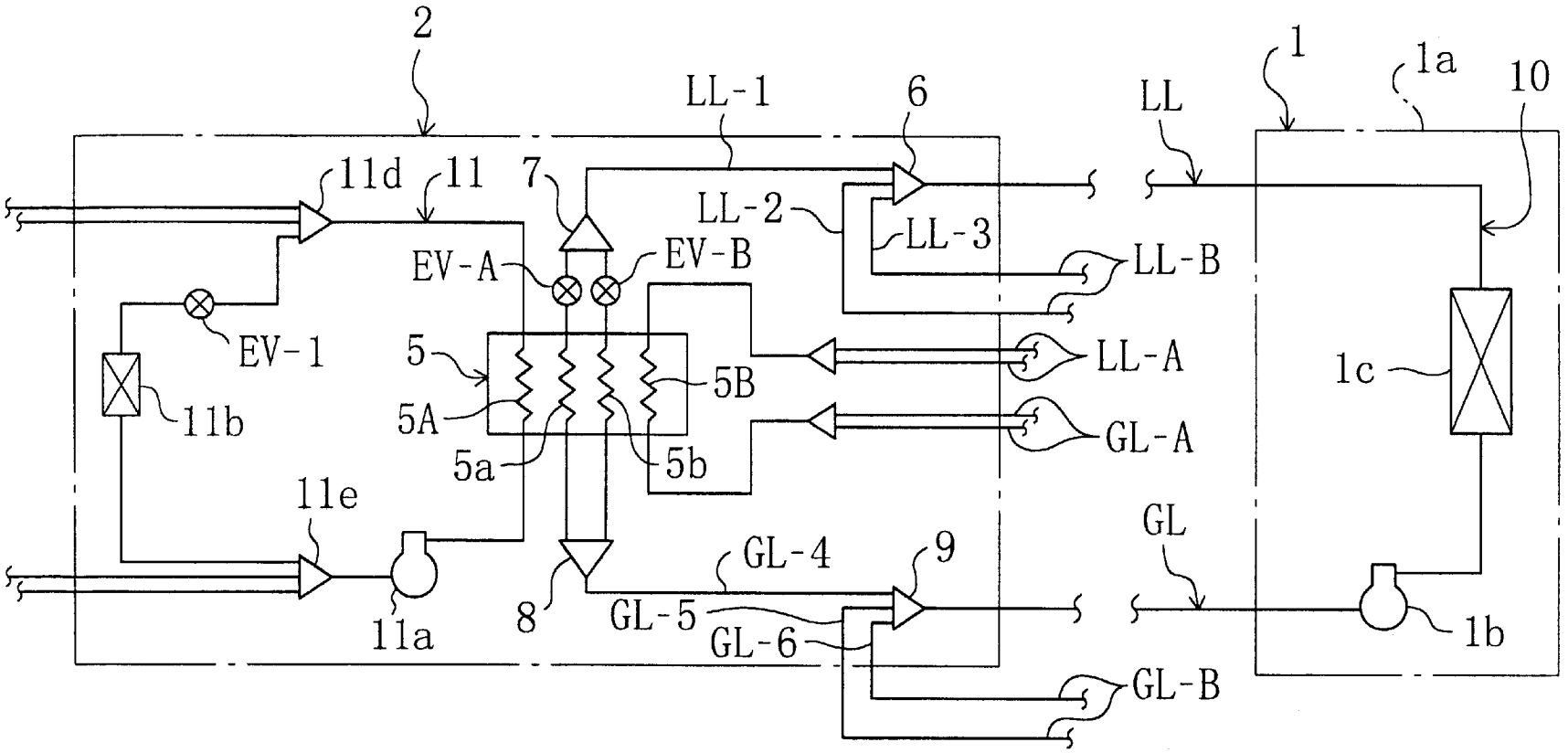
FIG. 8 is a diagram showing the refrigerant piping system of an outdoor unit and that of a parent unit in a third embodiment of the present invention.

Referring to FIG. 8, a third embodiment of the present invention is now described below.

FIG. 8 shows the third embodiment of the present invention which is the combination of the structures of the first and second embodiments. Referring to FIG. 8, therein shown are refrigerant line systems of the units (1) and (2) in accordance with the present embodiment. The reference numerals in the figures of these embodiments are the same for the common elements.

In the present embodiment, two types of the child freezers (3A, 3B) which are not shown in FIG. 8 are employed. The first type child freezer (3A, 3B) forms a closed loop with the secondary passage (5*a*) of the refrigerant heat exchanger (5) and corresponds to the child freezer (3A, 3B) of the first embodiment shown in FIG. 4. The second type child freezer (3A, 3B) contains therein the heat exchanger (3*c*) connected in parallel with the heat exchanger (11*b*) of the refrigerant circuit (11) in the parent unit (2) and corresponds to the child freezer (3A, 3B) of the second embodiment shown in FIG. 7.

Fourth Embodiment

A fourth embodiment of the present invention is now illustrated with reference to FIG. 9.

The parent unit (2) of the present embodiment has a structure different from that of the parent unit (2) of the first embodiment. Only differences between the structure of the parent unit (2) of the first embodiment and that of the parent unit (2) of the present embodiment are explained here. The reference numerals used in these embodiments are the same for the common elements.

Parent Unit

In the present embodiment, the parent unit (2) is placed in a refrigerated display case. The heat exchanger (11*b*) housed in the parent unit (2) forms no binary refrigeration cycle with the outdoor unit (1).

The downstream branch line (LL-2) branched out from the first flow divider (6) is connected, via the electric expansion valve (EV-1), to a liquid side of the heat exchanger (11*b*). On the other hand, one of the collecting lines that are collected at the second flow merging header (9), i.e., the collecting line (GL-5), is connected to a gas side of the heat exchanger (11*b*). Accordingly, together with the outdoor unit (1), the heat exchanger (11*b*) forms a unary refrigeration cycle.

The structure of the child freezers (3A, 3B, . . . ) and the connection of the child freezers (3A, 3B, . . . ) with the parent unit (2) are not described here because they are the same as in the first embodiment.

Three liquid lines (LL-A) and three gas lines (GL-A) are connected to the refrigerant heat exchanger (5) of the present embodiment. These liquid and gas lines (LL-A, GL-A) extend from the parent unit (2) and are connected to three child freezers (3A, 3B, . . . ). Refrigerant circulates between each child freezer (3A, 3B, . . . ) and the refrigerant heat exchanger (5).

Refrigerant Circulation Operation

The refrigerant circulation operation of the present embodiment is now described below.

The circulation operation of refrigerant flowing in the heat exchanger (11*b*) of the parent unit (2) is the same as the circulation operation of refrigerant flowing in the heat exchanger (4*b*) of each child refrigerator (not shown in the figure). In other words, refrigerant discharged from the primary compressor (1*b*) condenses in the outdoor heat exchanger (1*c*), is subjected to decompression in the electric expansion valve (EV-1). and exchanges heat with air in the refrigerator displace case to vaporize.

The circulation operation of refrigerant flowing in each child freezer (not shown in the figure) is the same as that in the first embodiment. Refrigerant circulates between each child freezer and the refrigerant heat exchanger (5) and each of the child freezers is cooled to a selected temperature.

The structure of the present embodiment makes it possible to place the parent unit (2) in a refrigerated display case. In addition, the refrigerant heat exchanger (5) is placed in only that refrigerated display case thereby providing a simplified structure.

Fifth Embodiment

Figure 10:
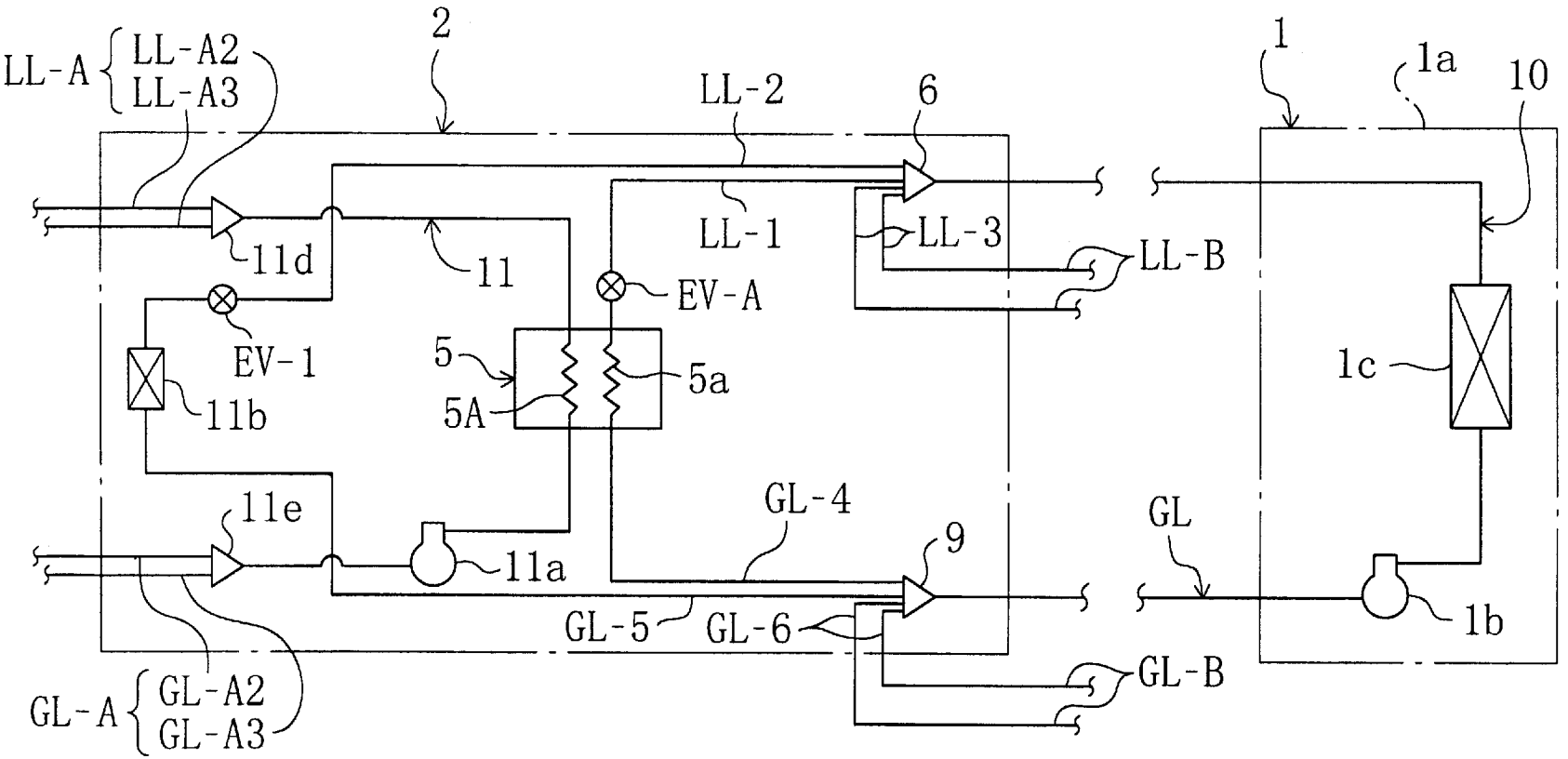
FIG. 10 is a diagram showing the refrigerant piping system of an outdoor unit and that of a parent unit in a fifth embodiment of the present invention.

Referring now to FIG. 10, a fifth embodiment of the present invention is now described below.

The parent unit (2) of the present embodiment has a structure different from that of the parent unit (2) of the second embodiment. Only differences between the structure of the parent unit (2) of the second embodiment and the structure of the parent unit (2) of the present embodiment are explained here.

Parent Unit

As in the fourth embodiment, the parent unit (2) of the present embodiment is disposed in a refrigerated display case.

The branch line (LL-2) branched out from the first flow divider (6) is connected, via the electric expansion valve (EV-1), to a liquid side of the heat exchanger (11*b*). On the other hand, one of the collecting lines that are collected at the flow merging header (9), i.e., the collecting line (GL-5), is connected to a gas side of the heat exchanger (11*b*). Accordingly, together with the outdoor unit (1), the heat exchanger (11*b*) forms a unary refrigeration cycle.

The structure of the child freezers (3A, 3B) and the connection of the child freezers (3A, 3B) with the parent unit (2) are not described here because they are the same as in the second embodiment.

Refrigerant Circulation Operation

How refrigerant circulates in the present embodiment is now described below.

The circulation operation of refrigerant flowing in the heat exchanger (11*b*) of the parent unit (2) is the same as in the fourth embodiment. The circulation operation of refrigerant flowing in each child freezer (each child refrigerator) is the same as in the second embodiment. By virtue of these operations, the inside of each display case is cooled to a selected temperature.

The structure of the present embodiment makes it possible to house the parent unit (2) in a refrigerated display case. In addition, the refrigerant heat exchanger (5) is deposed in only that refrigerated display case thereby providing a simplified structure.

Sixth Embodiment

Figure 11:
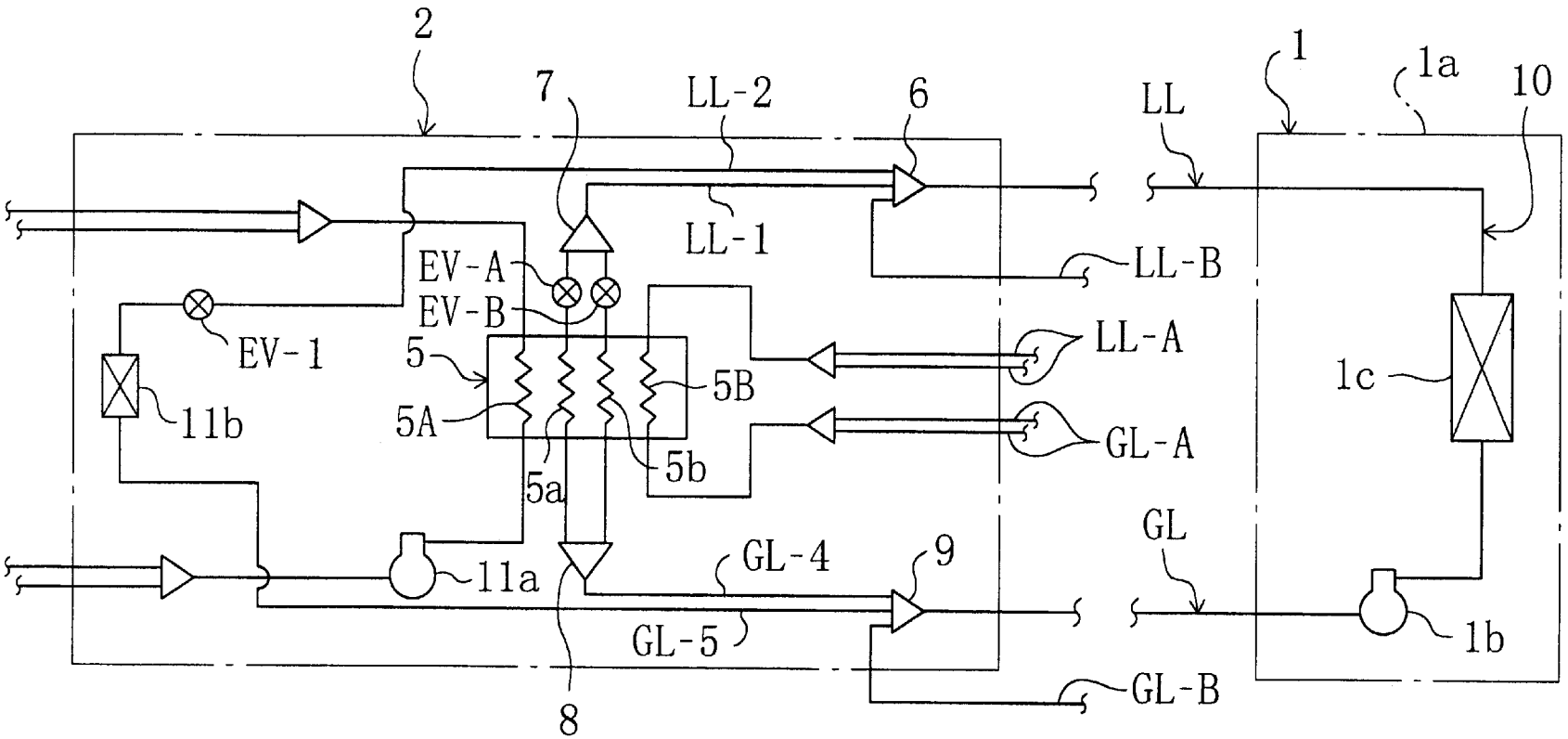
FIG. 11 is a diagram showing the refrigerant piping system of an outdoor unit and that of a parent unit in a sixth embodiment of the present invention.

Referring to FIG. 11, a sixth embodiment of the present invention is now described below.

FIG. 11 shows the present embodiment as a result of the combination of the structures of the fourth and fifth embodiments. Referring to FIG. 11, therein shown are refrigerant line systems of the outdoor unit (1) and the parent unit (2) in accordance with the present embodiment. The reference numerals in the figures of these embodiments are the same for the common elements.

In the present embodiment, two types of the child freezers (3A, 3B) which are not shown in FIG. 11 are employed. The secondary compressor (11*a*) is placed in the parent unit (2). A closed loop is formed between the first type child freezer (3A. 3B) and the secondary passage (5A) of the refrigerant heat exchanger (5), which corresponds to the fifth embodiment shown in FIG. 10. The casing (3*a*) of the second type child freezer (3A, 3B) contains therein the secondary compressor (3*b*) and there is formed a closed loop between the second type child freezers (3A, 3B) and the secondary passage (5B) of the refrigerant heat exchanger (5), which corresponds to the fourth embodiment shown in FIG. 9.

Other Embodiments

In each of the foregoing embodiments of the present invention, a plurality of child freezers (i.e. the child freezers (3A, 3B)) and a plurality of child refrigerators (i.e. the child refrigerators (4A, 4B)) are provided. In other embodiments of the present invention, however, only a plurality of child freezers may be employed.

For example, the example of FIG. 3 may include a single parent unit and one or more child freezers. In the example of FIG. 6, the provision of the child refrigerators (4A, 4B) may be omitted.

Figure 9:
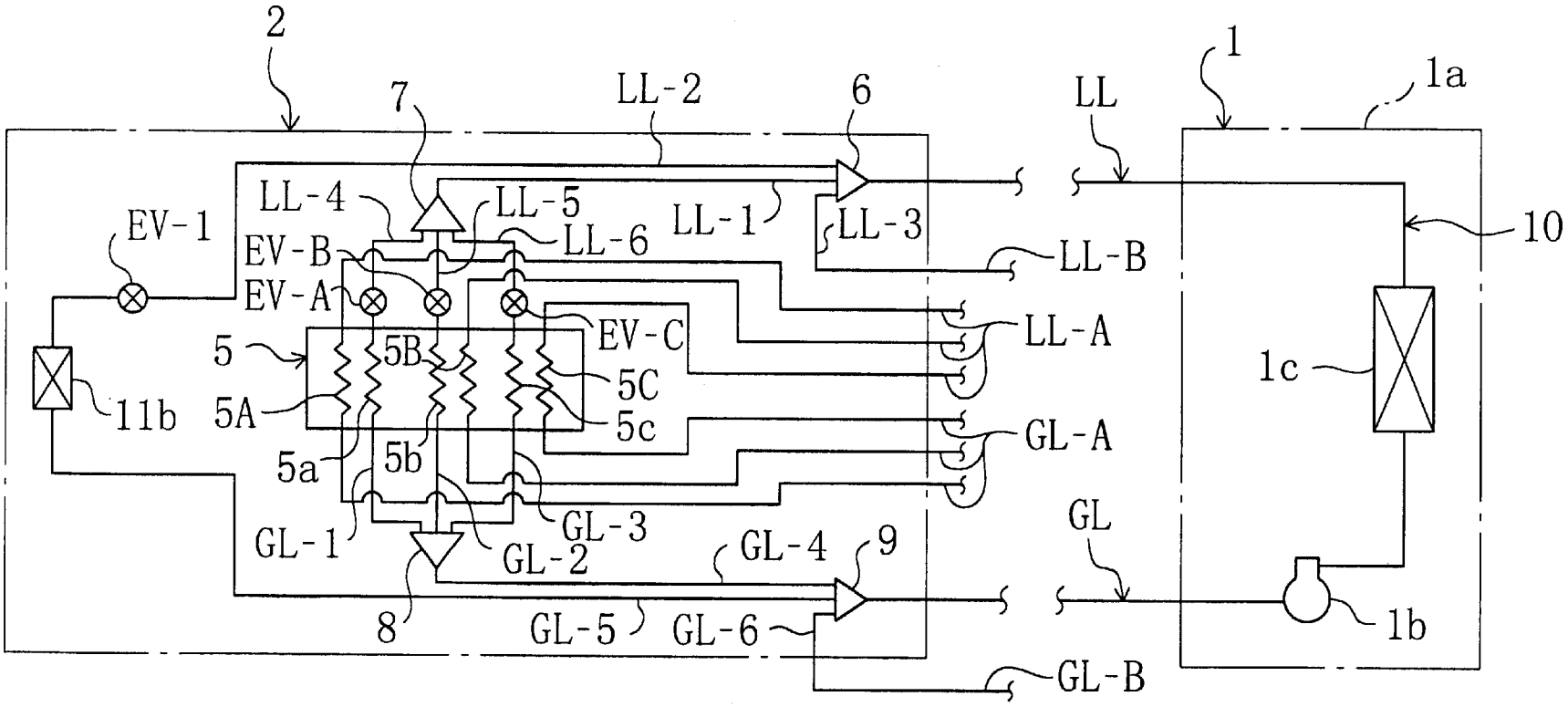
FIG. 9 is a diagram showing the refrigerant piping system of an outdoor unit and that of a parent unit in a fourth embodiment of the present invention.

For example, the example of FIG. 9 may include a single parent unit and one or more child freezers. In the example of FIG. 10, the provision of the child refrigerators (4A, 4B) may be omitted.

To sum up, the present invention is characterized in that at least one secondary refrigerant circuit of a vapor compression refrigeration cycle is provided and various child freezers and refrigerators are used according to the cooling temperature. As a result, a wider range of applications of the refrigeration systems of the present invention can be achieved.

In the foregoing embodiments of the present invention, the plate refrigerant heat exchanger (5) is used; however, a double pipe refrigerant heat exchanger can be used.

Each embodiment of the present invention has been described in terms of applications to food display cases; however, the present invention can be applicable in other types of refrigeration systems.

Industrial Applicability

As described above, the present invention finds industrial applications in cases where refrigeration is produced using primary and secondary refrigerant circuits and is particularly suitable for the cooling of food display cases.

What is claimed is:

1. A new refrigeration system comprising:

a primary refrigerant circuit through which a primary refrigerant circulates;

a secondary refrigerant circuit through which a secondary refrigerant circulates;

a refrigerant heat exchanger for allowing the primary refrigerant and the secondary refrigerant to exchange heats with each other; and a unit containing the refrigerant heat exchanger, wherein the secondary refrigerant circuit includes a plurality of heat exchangers and a branching portion for branching the secondary refrigerant circuit into plural sections such that respective flows of the secondary refrigerant through the plurality of heat exchangers are in parallel with one another, and the plurality of heat exchangers include: a first heat exchanger contained in the unit; and at least one second heat exchanger placed outside the unit and connected to refrigerant line extending from the branching portion to the outside of the unit.

2. A new refrigeration system comprising:

a primary refrigerant circuit through which a primary refrigerant circulates;

a plurality of secondary refrigerant circuits through each of which a secondary refrigerant circulates;

a refrigerant heat exchanger for allowing the primary refrigerant and the secondary refrigerant to exchange heats with each other; and a main unit containing the refrigerant heat exchanger, wherein a first one out of the plurality of secondary refrigerant circuits is contained in the main unit and includes a first heat exchanger through which the secondary refrigerant circulates, each of the other second refrigerant circuits than the first one includes a refrigerant line extending from the refrigerant heat exchanger to the outside of the main unit and a second heat exchanger through which the secondary refrigerant circulates, the second heat exchanger being connected to the refrigerant line and contained in a subunit placed outside the main unit.

3. A new refrigeration system comprising:

a primary refrigerant circuit through which a primary refrigerant circulates;

a secondary refrigerant circuit through which a secondary refrigerant circulates;

a refrigerant heat exchanger for allowing the primary refrigerant and the secondary refrigerant to exchange heats with each other; and a main unit containing the refrigerant heat exchanger, wherein the secondary refrigerant circuit includes a plurality of heat exchangers and a branching portion for branching the secondary refrigerant circuit into plural sections such that respective flows of the secondary refrigerant through the plurality of heat exchangers are in parallel with one another, and the plurality of heat exchangers include a first heat exchanger contained together with the branching portion in the main unit; and at least one second heat exchanger contained in a subunit placed outside the main unit and connected to a refrigerant line extending from the branching portion to the outside of the main unit.

4. A new refrigerant system comprising:

a primary refrigerant circuit through which a primary refrigerant circulates;

a secondary refrigerant circuit through which a secondary refrigerant circulates;

a refrigerant heat exchanger for allowing the primary refrigerant and the secondary refrigerant to exchange heats with each other; and a unit containing the refrigerant heat exchanger, wherein the primary refrigerant circuit includes a first heat exchanger and a branching portion for branching the primary refrigerant circuit into plural sections such that respective flows of the primary refrigerant through the refrigerant heat exchanger and the first heat exchanger are in parallel with each other, the first heat exchanger and the branching portion are contained in the unit, and the secondary refrigerant circuit includes a refrigerant line extending from the refrigerant heat exchanger to the outside of the unit and at least one second heat exchanger through which the secondary refrigerant circulates, the second heat exchanger being placed outside the unit and connected to the refrigerant line.

5. A refrigeration system comprising:

a primary refrigerant circuit through which a primary refrigerant circulates;

a secondary refrigerant circuit through which a secondary refrigerant circulates;

a refrigerant heat exchanger for allowing the primary refrigerant and the secondary refrigerant to exchange heats with each other; and a main unit containing the refrigerant heat exchanger, wherein the primary refrigerant circuit includes first heat exchanger and a branching portion for branching the primary refrigerant circuit into plural sections such that respective flows of the primary refrigerant through the refrigerant heat exchanger and the first heat exchanger are in parallel with each other, the first heat exchanger and the branching portion are contained in the main unit, and the secondary refrigerant circuit includes a refrigerant line extending from the refrigerant heat exchanger to the outside of the main unit and at least one second heat exchanger through which the secondary refrigerant circulates, the second heat exchanger being contained in a subunit outside the main unit and connected to the refrigerant line.

6. A refrigeration system comprising:

a primary refrigerant circuit through which a primary refrigerant circulates;

a secondary refrigerant circuit through which a secondary refrigerant circulates;

a refrigerant heat exchanger for allowing the primary refrigerant and the secondary refrigerant to exchange heats with each other; and a main unit containing the refrigerant heat exchanger, wherein the primary refrigerant circuit includes a first heat exchanger and a first branching portion for branching the primary refrigerant circuit into plural sections such that respective flows at of the primary refrigerant through the refrigerant heat exchanger and the first heat exchanger are in parallel with each other, and the secondary refrigerant circuit includes a plurality of second heat exchangers and a second branching portion for branching the secondary refrigerant circuit into plural sections such that respective flows through the plurality of second heat exchangers are in parallel with one another, the first heat exchanger the first branching portion and the second branching portion are contained in the main unit, and the plurality of second heat exchanges are respectively contained in a plurality of subunits placed outside the unit and connected to a refrigerant line extending from the second branching portion to the outside of the main unit.

7. The new refrigeration system as in either claim 2 or claim 5, wherein the subunit contains therein a secondary compressor, the secondary compressor has a discharge side which is connected to a gas side of the refrigerant heat exchanger through a gas line, and the second heat exchanger of the subunit has a liquid side which is connected to a liquid side of the refrigerant heat exchanger through a decompression mechanism and through a liquid line.

8. The refrigeration system as in either claim 3 or claim 6, wherein the secondary refrigerant circuit of the main unit is formed by sequential connection of a secondary compressor, a decompression mechanism, the first heat exchanger, and the refrigerant heat exchanger, and the second heat exchanger of the subunit has a liquid side which is connected to a liquid side of the refrigerant heat exchanger by a liquid line and the second heat exchanger has a gas side which is connected to a suction side of the secondary compressor by a gas line.

9. The new refrigeration system as in any one of claims 2, 3, 5 and 6, wherein the primary refrigerant circuit includes a refrigeration utilization side heat exchanger which is connected in parallel with the refrigerant heat exchanger and which is placed in a second subunit, the refrigeration utilization side heat exchanger has a liquid side and a gas side, the liquid side being connected to a liquid side of the refrigerant heat exchanger by a liquid line, and the gas side being connected to a gas side of the refrigerant heat exchanger by a gas line.

10. The refrigeration system as in any one of claims 1–6, wherein each of the first and second heat exchangers exchanges heat with air within an individual food display case to cool the air.

* * * * *

UNITED STATES PATENT AND TRADEMARK OFFICE

CERTIFICATE OF CORRECTION

PATENT NO. : 6,212,898 B1
DATED : April 10, 2001
INVENTOR(S) : Akitoshi Ueno et al.

It is certified that error appears in the above-identified patent and that said Letters Patent is hereby corrected as shown below:

Title page,
Under Related U.S. Application Data, please add
-- Continuation Prosecution Application of U.S. Patent Application No. 09/147,563 filed June 3, 1998, now issued. --

Claim 6,
Line 28, after "exchanger", add -- , --

Signed and Sealed this

Twenty-sixth Day of March, 2002

*Attest:*

*Attesting Officer*

JAMES E. ROGAN
*Director of the United States Patent and Trademark Office*